US010119780B1

(12) United States Patent
Bergeron

(10) Patent No.: US 10,119,780 B1
(45) Date of Patent: Nov. 6, 2018

(54) LIGHT GAS GUN PROJECTILE

(71) Applicant: David Wayne Bergeron, Albuquerque, NM (US)

(72) Inventor: David Wayne Bergeron, Albuquerque, NM (US)

( * ) Notice: Subject to any disclaimer, the term of this patent is extended or adjusted under 35 U.S.C. 154(b) by 0 days.

(21) Appl. No.: 15/869,414

(22) Filed: Jan. 12, 2018

(51) Int. Cl.

| | |
|---|---|
| ***F42B 6/10*** | (2006.01) |
| ***F41B 11/68*** | (2013.01) |
| ***F41A 1/04*** | (2006.01) |
| ***F41A 21/02*** | (2006.01) |
| ***F41B 11/723*** | (2013.01) |
| ***F41B 11/73*** | (2013.01) |
| ***F42B 30/02*** | (2006.01) |
| ***F41A 21/28*** | (2006.01) |

(52) U.S. Cl.
CPC ..... *F41B 11/68* (2013.01); *F41A 1/04* (2013.01); *F41A 21/02* (2013.01); *F41A 21/28* (2013.01); *F41B 11/723* (2013.01); *F41B 11/73* (2013.01); *F42B 6/10* (2013.01); *F42B 30/02* (2013.01)

(58) Field of Classification Search
CPC .... F42B 6/10; F42B 6/00; F42B 30/02; F42B 8/08; F42B 10/00; F42B 10/20; F42B 10/44; F42B 10/38
USPC ..... 124/57
See application file for complete search history.

(56) References Cited

U.S. PATENT DOCUMENTS

| | | | | | |
|---|---|---|---|---|---|
| 279,539 | A * | 6/1883 | Chamberlain | F42B 5/10 | 102/375 |
| 310,649 | A * | 1/1885 | Chamberlain | F42B 5/10 | 102/375 |
| 466,056 | A * | 12/1891 | Bott | F42B 5/10 | 102/375 |
| 1,274,281 | A * | 7/1918 | Kowalski | F42B 10/44 | 102/501 |
| 3,121,292 | A * | 2/1964 | Butler | A63H 27/14 | 446/212 |
| 3,913,487 | A * | 10/1975 | Scherr | F42B 10/38 | 102/501 |
| 4,411,200 | A * | 10/1983 | Brede | F42B 8/14 | 102/529 |
| 5,125,320 | A * | 6/1992 | Zielinski | F41A 1/04 | 89/7 |
| 5,965,836 | A * | 10/1999 | Rakov | F42B 15/00 | 102/374 |
| 7,568,433 | B1 * | 8/2009 | Farina | F42B 10/24 | 102/439 |

(Continued)

*Primary Examiner* — Derrick R Morgan

(57) ABSTRACT

An improved light gas gun launches a projectile in a light gas atmosphere as it travels through a frictionless barrel to achieve high muzzle velocities, decreased acoustic signatures, and increased ranges. The light gas atmosphere is introduced by a purge valve prior to firing or by a muzzle valve that holds a positive light gas pressure on the barrel and breech. The muzzle valve also routes the majority of propellant gases through a suppression canister, reducing the light gas gun's acoustic signature. The frictionless barrel uses light gas propellant routed through gas bearings to keep the projectile centered in the barrel and preclude the projectile from contacting the barrel walls, eliminating barrel wear. The system includes a projectile assembly that stores light gas from the firing and injects it into the boundary layer, reducing drag, increasing range and lethality, and decreasing acoustic signature of the projectile down range.

1 Claim, 10 Drawing Sheets

Projectile Assembly Detail

(56) References Cited

U.S. PATENT DOCUMENTS

| | | | | |
|---|---|---|---|---|
| 9,157,713 | B1 * | 10/2015 | Peterson | F42B 8/00 |
| 9,366,511 | B1 * | 6/2016 | Wood | F42B 10/46 |
| 2011/0094372 | A1 * | 4/2011 | Carlson | F42B 10/40<br>89/27.11 |
| 2011/0155016 | A1 * | 6/2011 | Marx | F42B 10/26<br>102/524 |
| 2015/0083010 | A1 * | 3/2015 | Macdonald | F42B 8/20<br>102/498 |
| 2016/0161212 | A1 * | 6/2016 | Bergeron | F41B 11/68<br>124/73 |
| 2016/0169644 | A1 * | 6/2016 | Ziegler | F42B 10/38<br>244/3.23 |
| 2016/0231093 | A1 * | 8/2016 | Lemke | F42B 12/74 |
| 2016/0238361 | A1 * | 8/2016 | Rachlin | F42B 5/02 |
| 2017/0227339 | A1 * | 8/2017 | Adams | F42B 10/40 |
| 2017/0322001 | A1 * | 11/2017 | Panousakis | F42B 5/02 |
| 2018/0120069 | A1 * | 5/2018 | Kim | F42B 10/44 |

* cited by examiner

Light Gas Gun

Light Gas Gun

Light Gas Gun

Light Gas Gun

Barrel Section Detail
For Projectile Assembly

Barrel Section Detail
For Projectile Assembly

Muzzle Valve Assembly Detail

Breech Assembly

Projectile Assembly Detail

Piston Assembly Detail

LIGHT GAS GUN PROJECTILE

CROSS-REFERENCE TO RELATED APPLICATIONS

This application is a divisional application of pending U.S. patent application Ser. No. 14/205,064 filed on Mar. 14, 2013 entitled Light Gas Gun, the entirety of which is incorporated herein by reference.

BACKGROUND OF THE INVENTION

Field of the Invention

This invention relates to a means for propelling a projectile at relatively high muzzle velocities using light gas as the working fluid and increasing range and lethality while minimizing visible and acoustic signatures.

Prior Art

U.S. Pat. No. 3,186,304
U.S. Pat. No. 3,311,020
U.S. Pat. No. 3,465,638
U.S. Pat. No. 4,038,903
U.S. Pat. No. 4,349,200
U.S. Pat. No. 4,527,483
U.S. Pat. No. 4,658,699
U.S. Pat. No. 4,712,465
U.S. Pat. No. 4,917,335
U.S. Pat. No. 5,303,633
U.S. Pat. No. 6,679,178
U.S. Pat. No. 7,775,148
U.S. Pat. No. 7,754,413
U.S. Pat. No. 8,141,811

DESCRIPTION OF THE PRIOR ART

Hypervelocity guns have been used since the late 1940s for impact and strength of materials research. These guns use light gases, primarily hydrogen, as the working fluid to propel projectiles at speed ranging from 5 to 30 thousand feet per second. Much of the development of the guns is centered on improving the light gas propellant delivery to the breech. Single stage, two stage, and three stage pistons schema have been proposed, most with the intention of ever higher muzzle velocities.

Koth, U.S. Pat. No. 7,954,413, proposes an improved two-stage light gas gun for launching projectiles at high speeds. The gun consists of three tubes: the expansion, pump, and launch tubes. The expansion tube contains a close-fitting expansion piston that is propelled by an explosive charge. The expansion piston in turn drives the pump piston housed within the pump tube by means of a rod connecting the two pistons. The action of the pump piston adiabatically compresses and heats a light gas of hydrogen or helium, bursting a diaphragm at a predetermined pressure and expelling the projectile from the launch tube at a very high speed. These combustion products can cause fouling of the pump tube, making it impractical to convert the design to a fieldable weapon system. It also uses a single use diaphragm, making rapid fire difficult.

Guthrie, et al, U.S. Pat. No. 5,303,633, proposes a shock compression jet gun with associated explosive charge assembly. The shock compression jet gun features a breech for storage of the explosive charge assembly, a projectile tube, and an expansion nozzle disposed between the breech and projectile tube. The expansion nozzle includes converging and diverging passageways. The explosive charge assembly includes a shock absorbing outer casing, a detonator, a shaped charge positioned within the casing and a compressible medium retained within a recess formed in the shaped charge. The compressible medium is maintained within the recess by way of a membrane sealing one end of the casing. In a preferred embodiment the compressible medium is a liquid such as ammonia, water or a mixture of liquid ammonia and water which dissociate(s) into a mixture of light gases upon detonation of the shaped charge. The design has elements that would lend itself to large guns such as artillery or naval guns, but would still be difficult to transition to a man-portable weapon. In addition, the corrosive nature of anhydrous ammonia or water would create severe wear within the breech, making the fielded system unreliable and decreasing maintainability.

Mcdermott, U.S. Pat. No. 7,775,148, proposes launching payloads at high velocity uses high-pressure gas or combustion products for propulsion, with injection of high pressure gas at intervals along the path behind the payload projectile as it accelerates along the barrel of the launcher. An inner barrel has an interior diameter equal to the projectile diameter or sabot containing the projectile. An outer casing surrounds the inner barrel. Structures at intervals attach the outer casing and the inner barrel. An axial gas containment chamber (AGC) stores high pressure gas between the inner barrel wall, the outer casing wall, and enclosure bulkheads. Pressure-activated valves along the barrel sequentially release the high pressure gas contained in the AGC in to the barrel to create a continuously refreshed high energy pressure heads behind the projectile as it moves down the barrel. A frangible cover at the exit end of the barrel allows the barrel to be evacuated prior to launch. The launcher is rapidly recyclable. The valves close automatically after the projectile has exited the barrel, allowing a new projectile to be introduced into the breech and the AGC to be recharged with high-pressure gas. The system is designed as a launch system that can be rapidly reconfigured for launch. The complexity of the system and the necessity of evacuating the barrel preclude its use as a fieldable weapon system.

Kremeyer, U.S. Pat. No. 8,141,811; proposes modifying a shock wave in a gas by emitting energy to form an extended path in the gas; heating gas along the path to form a volume of heated gas expanding outwardly from the path; and directing a path. The volume of heated gas passes through the shock wave and modifies the shock wave. This eliminates or reduces a pressure difference between gas on opposite sides of the shock wave. Electromagnetic, microwaves and/or electric discharge can be used to heat the gas along the path. This application has uses in reducing the drag on a body passing through the gas, noise reduction, controlling amount of gas into a propulsion system, and steering a body through the gas. An apparatus is also disclosed. The solution requires considerable hardware be added to the projectile, making it unsuitable for a small caliber round. The energy and resultant energy generation or storage required to drive the emitters also outweighs any benefit derived from the reduction in drag.

None of the systems described in the prior art is adaptable to a man-carried weapon system. Each has limitations that preclude sustained rates of fire, light weight, and the simplicity and reliability necessary for a weapon system.

SUMMARY OF THE INVENTION

The light gas gun of this invention is a compressed gas weapon or launcher that uses helium or hydrogen as the working fluid. The light gas gun described herein provides a unique and potentially devastating weapon that will provide the operator greater range, superior lethality, more stealth, and ultimately greater survivability than any other weapon of its kind. The gun is designed to provide muzzle velocities greater than any conventional firearm of the same caliber currently in use. Two embodiments are capable of firing standard caliber projectiles, but using the unique projectile assembly maintains projectile velocity much farther than conventional rounds, significantly increasing range and lethality.

The gun of this invention consists of five primary elements: the frictionless barrel assembly, the breech assembly, the projectile assembly, the muzzle valve assembly, and the light gas that is used as the propellant. The barrel assembly uses gas bearings to minimize projectile assembly contact with the barrel walls. The gas bearings virtually eliminate friction with the barrel, thus greatly reducing barrel wear. Given the substantially increased muzzle velocities capable with a light gas gun, this is an enabling feature.

The breech assembly includes the trigger valve, a receiver locking bolt 17, used in loading the round, the breech where the projectile is held prior to firing the gun, and a means of providing high pressure light gas propellant. Propellant can be provided by any number of means, including a simple reservoir, or using mechanically, combustion, or gas driven pistons.

The projectile assembly is a center-of-pressure/center-of-gravity (CP/CG) stabilized round, capable of storing light gas and injecting the light gas into the boundary layer as the round travels downrange. The shape of the round and the material of construction enable a ballistically stable projectile superior to standard firearm rounds.

Each of the embodiments of this invention incorporates a means of firing the weapon with the barrel filled with light gas. This creates an environment where the internal ballistics of the gun are governed by the properties of the light gas. Because the speed of sound is substantially higher for light gases, all the internal ballistics are subsonic, greatly increasing efficiency of the gun. This is accomplished by either purging the gun barrel with light gas immediately prior to firing the gun or by continually maintaining a positive light gas pressure in the gun using a muzzle valve assembly. By using the muzzle valve assembly, the majority of propellant gases can be routed through a suppression canister, reducing the acoustic signature of the gun.

All of these elements combined enable a gun that can be adapted to use as a very powerful handgun, a sniper rifle with exceptional performance, artillery with extreme range, a naval gun uniquely adapted to surface warfare, or even an orbital launch system that eliminates the first stage booster.

OBJECT OF THE INVENTION

The first object of this invention is to improve efficiency by using a light gas atmosphere in the barrel in front of the projectile, reducing the energy required to propel the projectile out of the barrel.

A second object of this invention is to improved efficiency by using a gas bearing in the barrel wall to virtually eliminate friction in the barrel, eliminating barrel wear, and reducing the requirement for high peak pressures in the barrel.

A third object of this invention is to increased muzzle velocities by using light gas as a propellant in a gun that can be made man-portable.

A fourth object of this invention is to reduce the acoustic signature of the light gas gun to levels well below those of conventional firearms.

A fifth object of this invention is to increase the range of the gun by significantly increasing the muzzle velocity of the gun as compared to conventional firearms.

A sixth object of this invention is to increase range by reducing the drag on the projectile.

A seventh object of this invention is to increase the energy on target for a given range, as compared to comparable firearms.

An eighth object of this invention is to reduce the acoustic signature of the projectile downrange.

A ninth object of this invention is to improve reliability of the gun by reducing possible outside contaminants such as dirt and sand from entering the gun.

A tenth object of this invention is to increase accuracy of the gun by eliminating second and third order effects that impact standard firearms.

A final object of this invention is to reduce the muzzle flash by using a non-combusted light gas as a propellant.

DEFINITIONS

Figure 1A:
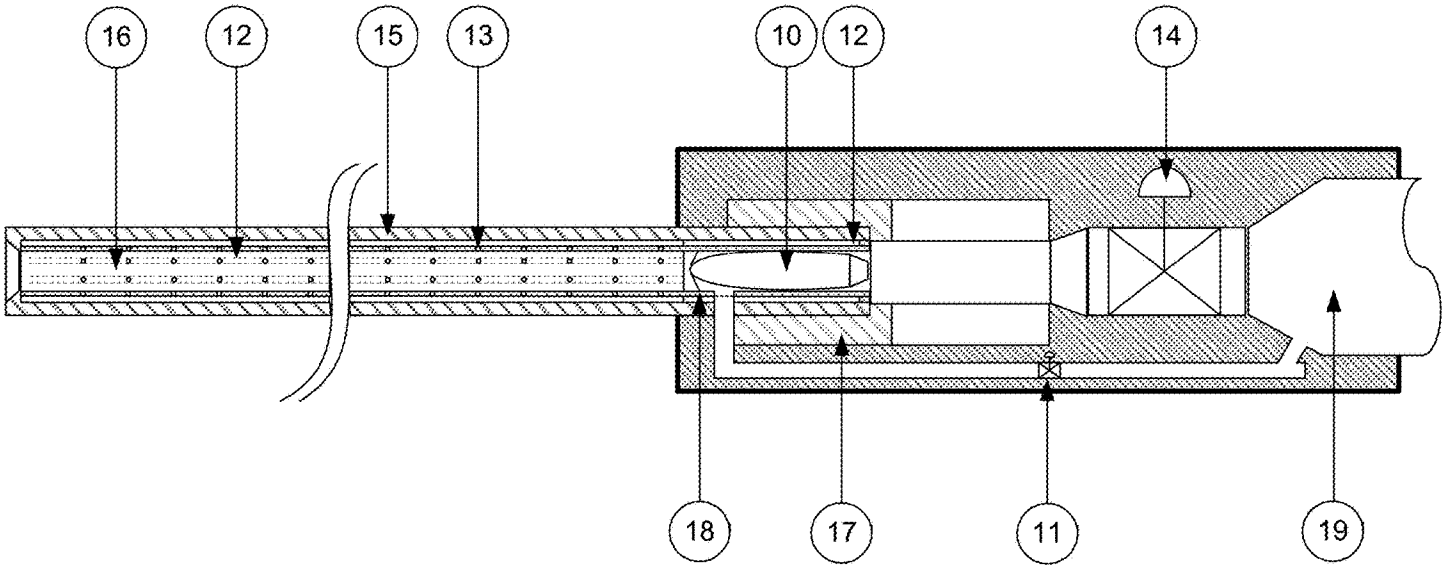
FIG. 1A-D Four Embodiments of the Light Gas Gun

Aft Projectile Body. The rearward piece of the projectile assembly that contains the spring loaded valve and the projectile spring. The aft projectile body is hollow and threaded into the forward projectile body. Assembled, they make up the projectile assembly.

Barrel Assembly. A two piece barrel made up of an inner tube and an outer tube. The inner tube is press fit into the outer tube and has channels cut into the outer diameter and holes drilled in the channels that allow light gas to flow down the barrel and into the interior of the inner tube, acting as gas bearings to keep the round centered in the barrel.

Breech. The cylindrical cavity where the projectile or projectile assembly rests prior to firing the light gas gun.

Breech Assembly. Made up of the breech body, the receiver locking bolt, the trigger valve, and the receiver safety. The breech assembly is mechanically connected to the barrel assembly on the front or muzzle end and to the light gas source.

Breech Assembly Body. The part to which the receiver locking bolt, trigger valve, receiver safety, and barrel assembly are connected. The breech is bored into the breech assembly body and aligned with the barrel assembly.

Channel. Rectangular grooves milled into the outside wall of the inner tube to allow light gas to flow the length of the barrel, supplying gas to the gas bearing ports drilled into the bottom of the channels. Channels are milled at angles in embodiment one and three in order to create a vortex to spin stabilize the round, but normal to the outside wall for embodiments two and four where spin stabilization is not required.

$CO_2$ Piston. The driving piston in the dual piston assembly shown in embodiment four, and part of the best mode. Larger in diameter than the light gas piston so as to multiply the force on the light gas piston. In addition to using high pressure $CO_2$, it is assisted by a pressure boosting spring.

Dual Piston Assembly. The mechanism that provides the light gas propellant to the breech assembly in embodiment four. It consists of a $CO_2$ piston, a light gas piston, mechanisms for actuating the assembly, and the necessary gas connections and vents to prepare the assembly for firing.

Forward Projectile Body. The forward piece of the projectile assembly, threaded to accept the aft projectile body, and bored down the centerline to provide a path for light gas to the meplat of the round.

Gas Bearings. Holes in the inner tube, aligned the length of the barrel, equally spaced around the circumference of the inner tube, and connected by channels running from the breech end of the inner tube to just shy of the muzzle end of the inner tube. The gas bearings direct high pressure light gas axially inward, toward the round, keeping it centered in the inner tube.

Gas Bearing Port. One of the holes drilled in the inner tube that directs light gas toward the projectile.

Gas Directing Tube. The hole bored into the forward projectile body to direct light gas to the meplat of the round, ensuring sufficient light gas flow into the boundary layer at the front of the round.

Inner Tube. The interior cylinder of the barrel assembly, press fit into the outer tube, with channels milled the length of the tube and gas bearing ports drilled at specified distances, centered in the channels.

Leaf Bore. A hole bored in the muzzle valve leaf that allows the round to exit the light gas gun when aligned with the barrel assembly bore and the other muzzle valve leaves.

Light Gas. Elemental helium or molecular hydrogen.

Light Gas Piston. The piston that compresses the light gas used as the propellant in embodiment four. Driven by the $CO_2$ piston. It is also used to reset the $CO_2$ piston after firing by venting the gas in the $CO_2$ piston and driving both pistons and compressing the pressure boosting spring back to their firing position with light gas from the supply source.

Muzzle Valve. The valve that opens to allow the round to exit the light gas gun and closes to retain unused light gas. The muzzle valve and opposing multi-leaf valve are used interchangeably in embodiment four. The opposing multi-leaf valve is a specific type of muzzle valve.

Muzzle Valve Assembly. Consists of a muzzle valve body, a muzzle valve, a plurality of muzzle vent valves, hydraulic actuators to drive the muzzle valve, and a suppression canister. The assembly seals the light gas gun in order to hold a positive pressure in the breech and barrel. Opens the muzzle valve to allow the round to exit and to vent propellant gases to the atmosphere through the suppression canister. The muzzle valve assembly is mechanically connected to the barrel assembly on the muzzle end.

Muzzle Valve Body. The structure to which all other muzzle valve components are attached.

Muzzle Valve Chamber. The space between the end of the barrel assembly and the muzzle valve where propellant light gas is directed to the muzzle vent valves.

Muzzle Valve Leaf. A component of the specific opposing multi-leaf valve used in embodiments three and four. A plurality of the leaves are used to allow the round to leave the light gas gun when they are hydraulically driven together to align the holes bored in the individual leaves with the bore of the barrel. When hydraulic pressure is released, the leaves are then reset by springs that drive them back into their pre-fire positions, sealing the muzzle.

Muzzle Vent Valve. A small pressure relief valve that opens whenever pressure in the muzzle chamber rises above a predetermined level. The muzzle vent valve vents to the atmosphere through the suppression chamber.

Opposing Multi-Leaf Valve. The specific type of muzzle valve used in the third and fourth embodiments, designed to minimize the impulse imparted to the light gas gun while opening and closing. May be used interchangeably with muzzle valve.

Outer Tube. The exterior cylinder of the barrel assembly. Attached to the breech assembly and, in embodiments three and four, the muzzle valve assembly. The inner tube is press fit into the outer tube.

Projectile. A standard caliber bullet or artillery round

Projectile Assembly. A specialized bullet that stores high pressure light gas that it injects into the boundary layer as the bullet travels downrange.

Projectile Spring. The spring in the projectile assembly that keeps the spring loaded valve seated. The spring is compressed when external pressure exceeds the projectile assembly internal pressure plus the compression strength of the spring, opening the spring loaded valve. When the pressures are equalized the spring loaded valve closes.

Purge Valve. A valve that is triggered in the firing sequence to put medium pressure light gas into the front of the breech. The light gas flows long enough to ensure the barrel is clear of air and filled with light gas. The valve closes as the trigger valve opens.

Receiver Locking Bolt. The mechanism that allows a round to be loaded into the breech. It unlocks, moves toward the rear sufficiently far to allow loading of the round, then moves forward after the round is loaded, locks, and seals the breech in preparation for firing.

Receiver Safety. A spring-loaded mechanism that holds the round in place in the breech. It includes a mechanical lock that prevents the round from moving until the firing safety is turned to the fire position. This prevents accidental firing of the round.

Round. Used interchangeably to denote either the projectile or the projectile assembly Suppression Canister. A hollow cylinder connected to the muzzle valve assembly that surrounds the barrel assembly and is connected to the breech assembly. The cylinder contains baffles and flame retardant foam that allows the light gas entering from the muzzle valve assembly to exit to the atmosphere through vent holes in the side of the cylinder, directing the light gas away from the operator. The baffles and the foam reduce the acoustic signature of the light gas gun and help to prevent contaminants from reaching light gas gun mechanisms.

Suppression Vent. The holes drilled into the side of the suppression canister that direct light gases away from the operator.

Trigger Valve. The valve that controls the light gas flow to the rear of the breech. The trigger valve is actuated with the pull of the trigger to allow high pressure light gas to flow for sufficient time to propel the round out of the barrel.

DETAILED DESCRIPTION OF THE INVENTION

This system description describes four different embodiments of the invention. Each embodiment is representative of different potential applications and will have different means of providing the necessary light gas to be used as the propellant.

Figure 2A:
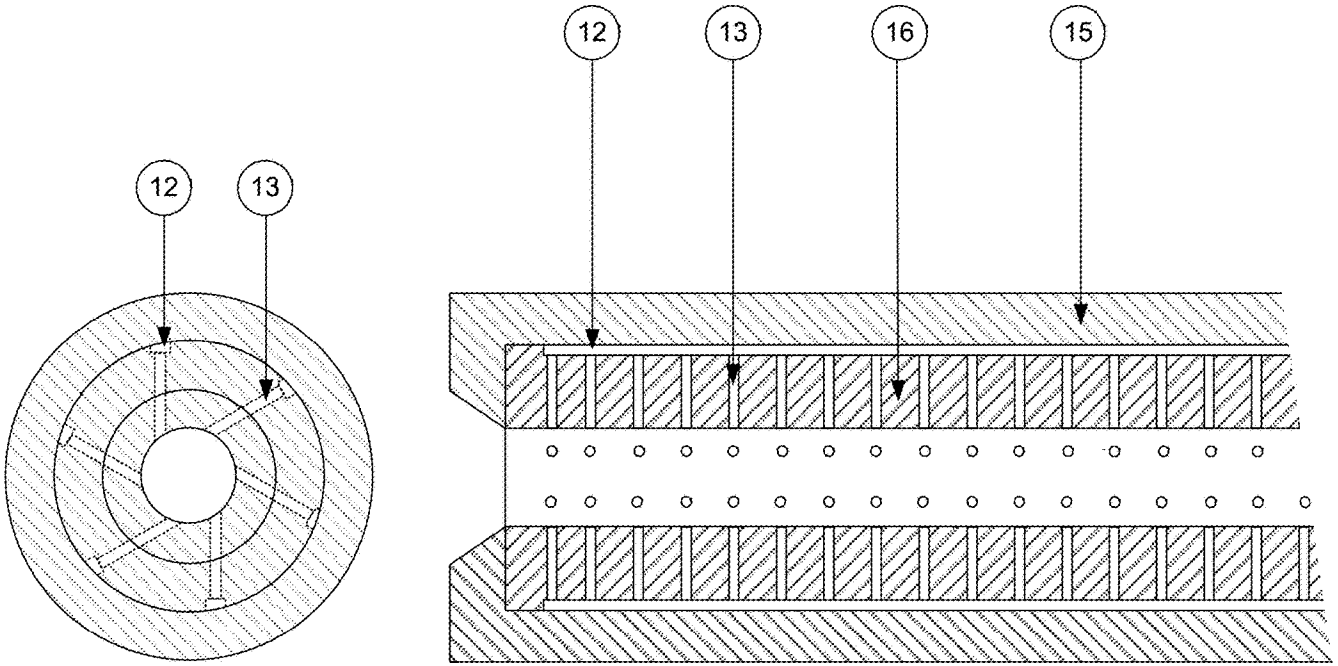
FIGS. 2 A& B Barrel Assembly Detail For Projectile and Projectile Assembly

The light gas gun of this invention FIGS. 1A/D is a compressed gas gun that uses helium or hydrogen as the working fluid, fires a projectile 10 or projectile assembly 20, has a frictionless barrel FIG. 2A/B, and means to fire the round while the barrel contains light gas. Each embodiment shown has a breech assembly FIG. 4 that allows loading of the projectile 10 or projectile assembly 20 in preparation for firing the gun, then reloading to enable firing again.

The first embodiment FIG. 1A uses light gas to purge the barrel assembly FIG. 2A/B of air, ensuring internal ballistics are subsonic. The first embodiment fires a standard caliber projectile 10. It also includes the frictionless barrel assembly FIG. 2A, which increases efficiency and reduces barrel wear. High pressure light gas is provided to the light gas gun by a simple reservoir through the breech assembly FIG. 4.

Figure 1B:
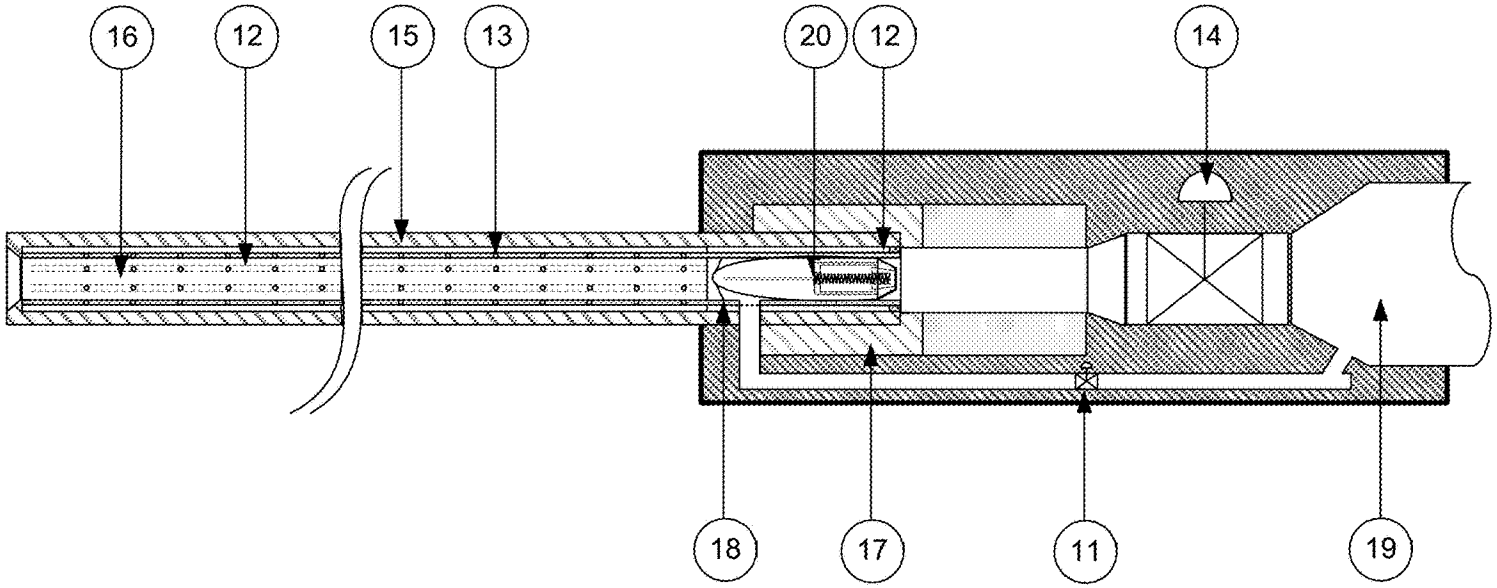

The second embodiment, FIG. 1B introduces the projectile assembly 20, which stores light gas internally as the light gas gun is fired, and then injects the light gas into the boundary layer as the projectile assembly 20 travels downrange. This reduces drag, thus increasing range, accuracy, energy on target, and lethality as well as reducing the acoustic signature of the projectile assembly downrange when compared to conventional firearms or artillery and projectiles of the same caliber. The projectile assembly 20 is stabilized using a forward center of gravity and a trailing center of pressure. This eliminates spin drift error that is inherent in spin stabilized projectiles 10, thus increasing accuracy at extreme ranges.

The second embodiment would also typically use a simple reservoir to provide the light gas propellant. By adding a heater to the reservoir, the light gas could be heated prior to use to increase the speed of sound in the light gas. The hotter light gas would mostly impact the projectile assembly 20 performance by injecting the hotter gas into the boundary layer.

Figure 4:
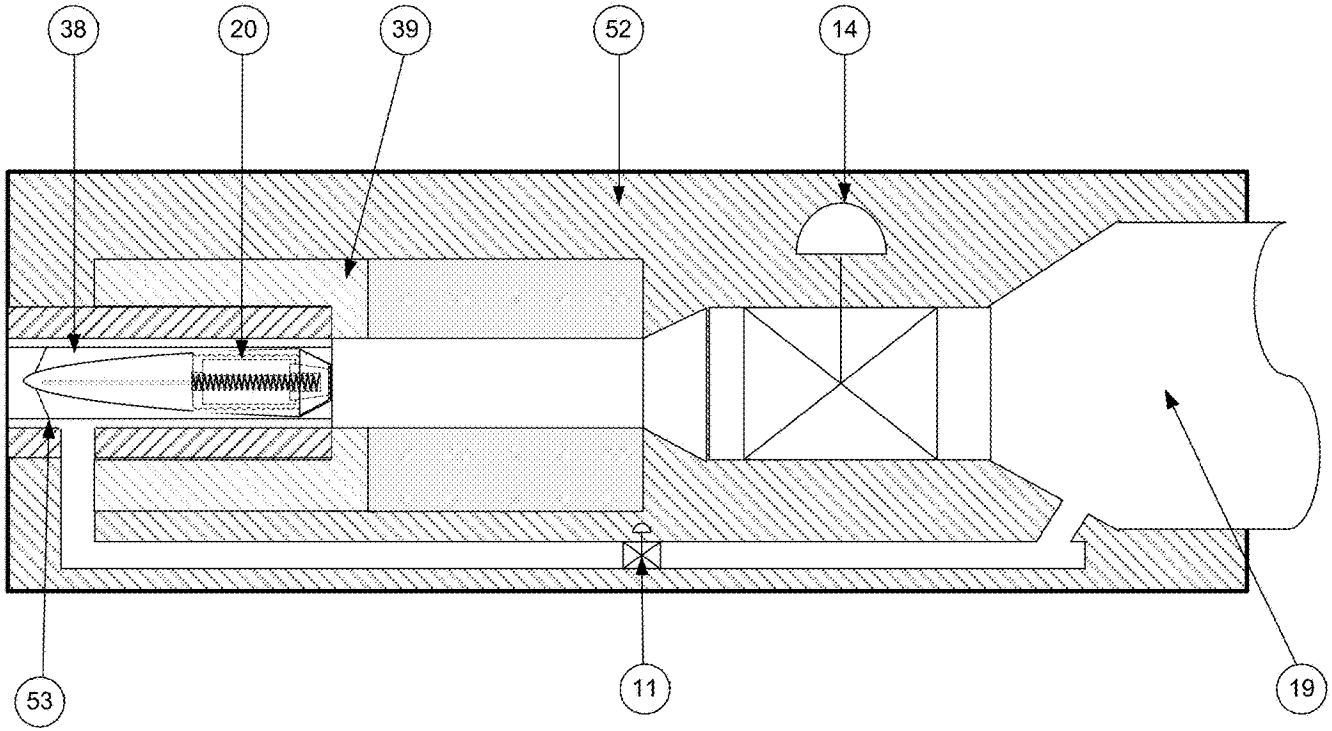
FIG. 4 Breech Assembly Detail
Figure 5:
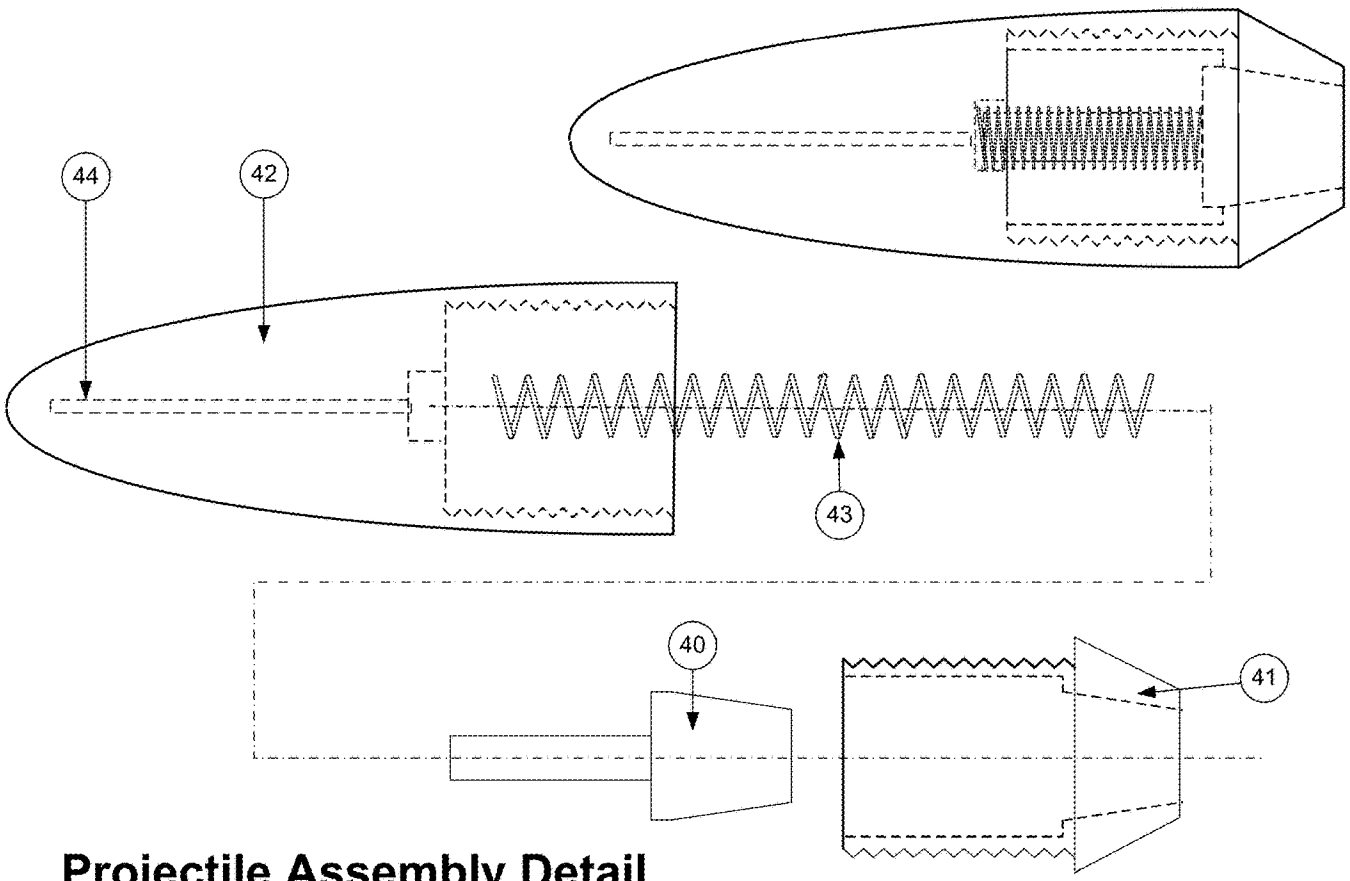
FIG. 5 Projectile Assembly Detail

The second embodiment contains the other elements from the first embodiment, the breech assembly FIG. 4, and the frictionless barrel assembly FIG. 2A.

Figure 3:
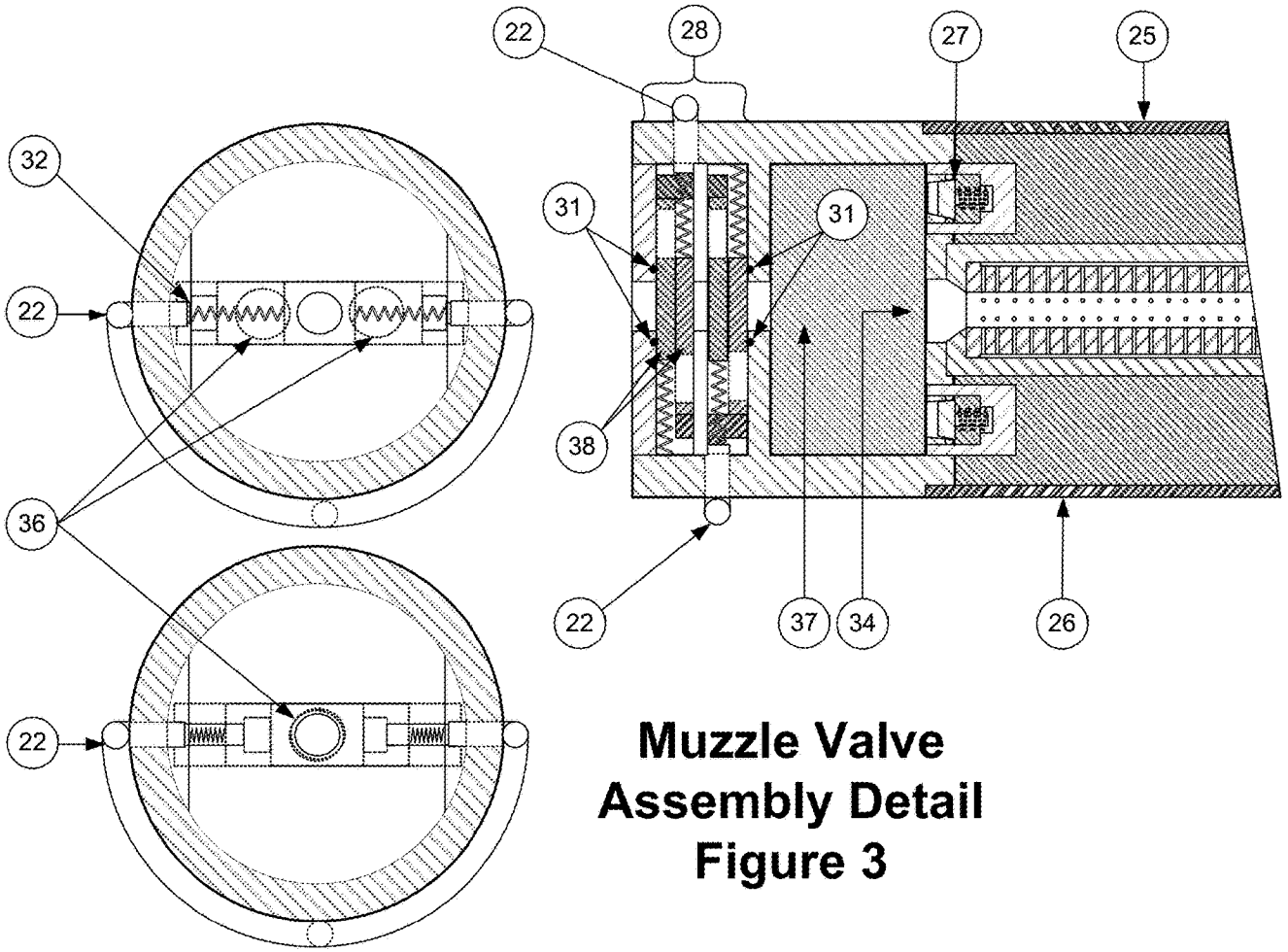
FIG. 3 Muzzle Valve Assembly Detail

The third embodiment introduces the muzzle valve assembly FIG. 3, while using a standard caliber projectile 10. The muzzle valve FIG. 3 eliminates the need to purge the barrel prior to firing by maintaining a positive pressure in the light gas gun. The muzzle valve FIG. 3 also directs the majority of propellant gas through a suppression canister, reducing the acoustic signature significantly.

Figure 2B:
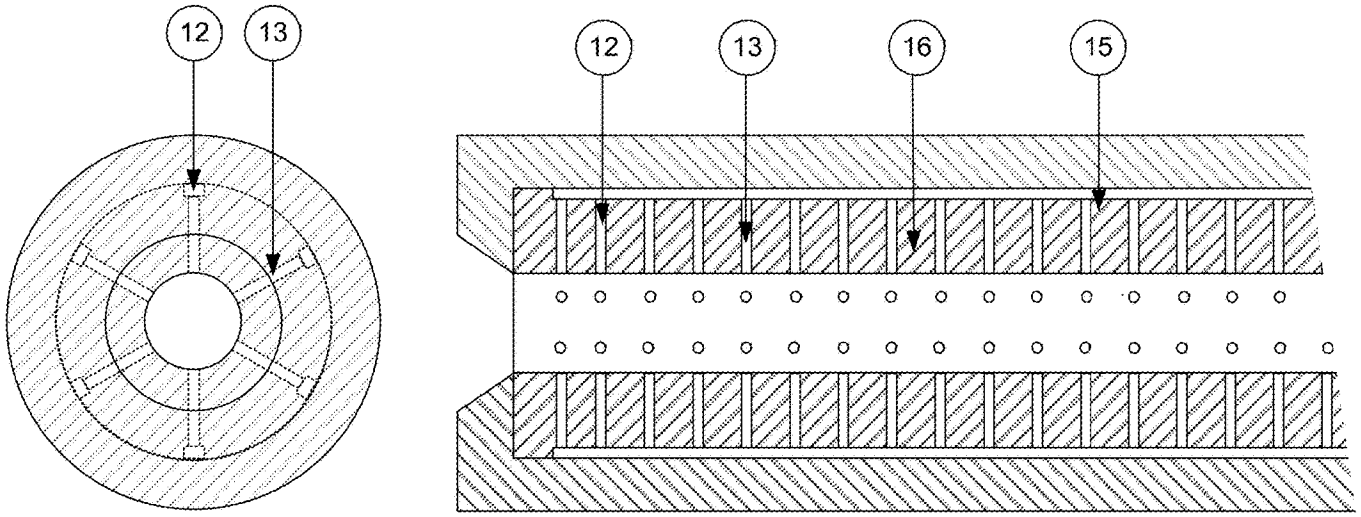

The fourth embodiment is the best mode, and includes the projectile assembly 20, the frictionless barrel assembly FIG. 2B, and the muzzle valve FIG. 3 as well as the breech assembly FIG. 4. This mode provides the greatest performance in terms of increased muzzle velocity, range, lethality, reduced acoustic signature for the light gas gun and the projectile traveling downrange, elimination of the muzzle flash, and increased reliability as a result of a completely sealed weapon system.

There are numerous applications for the different embodiments described herein, including handguns, rifles, ground artillery, naval guns, industrial processes, research, and even orbital launch systems. These different applications might use substantially different methodologies for providing the necessary light gas propellant at the pressures, temperatures, and quantities required, but they all contain the respective elements of the four embodiments. A relatively simple reservoir of light gas large enough to ensure a constant pressure at the firing valve after it is opened might be sufficient for some applications. Others would likely need a two stage piston that could be powered by other pressurized gas, steam, hydraulics or combustive propellants.

First Embodiment

The projectile 10 is loaded into the breech assembly FIG. 4 by opening the receiver locking bolt 17, inserting the projectile 10, then closing and locking the receiver locking bolt 17. With the projectile 10 loaded, the trigger signal is activated, first opening the purge valve 20 for sufficient time to purge the barrel of air and replacing it with light gas, then the trigger valve 14 is opened and the purge valve 20 is closed simultaneously. Light gas entering the breech 38 from the trigger valve 14 propels the projectile 10 down the barrel. A light gas pressure wave also travels the channels 12 on the outside of the inner tube 15 and enters the inner tube 15 through the gas bearing ports 13, creating a vortex in the barrel that imparts a spin on the projectile 10 as it travels down the barrel. The light gas travels the channels 12 faster than the pressure wave behind the projectile 10, allowing the light gas to flow through the gas bearings to impinge upon the projectile 10 and prevent it from contacting the barrel assembly FIG. 2B walls. Because the greatest diameter of the projectile 10 is smaller than the inside diameter of the inner tube 15 by a few thousandths of an inch, there is gas flow between the projectile 10 and the barrel that also helps to keep the round centered in the barrel. The trigger valve 14 closes after a specified time, on the order of a few milliseconds.

Second Embodiment

The second embodiment is identical to the first with two exceptions. The projectile assembly 20 is substituted for the known projectile 10. The channels 12 and gas bearing ports 13 are cut and drilled normal to outside wall of the inner tube 15, as it is no longer necessary to impart spin on the projectile assembly 20.

The projectile assembly 20 is loaded in the same fashion as in the first embodiment. When the light gas gun is fired, the pressure behind the projectile assembly 20 increases rapidly. The spring loaded valve 40 in the aft projectile body 41 of the projectile assembly 20 opens as the pressure external to the projectile assembly 20 is greater than the internal pressure plus the compression strength of the projectile spring 43. The spring loaded valve 40 closes as the internal and external pressures equalize. The forward and aft projectile bodies 42/41, as well as the spring loaded valve 40, are constructed of sintered metal. With high pressure light gas stored in the projectile assembly 20, the light gas starts to flow through the walls of the projectile into the boundary layer as the projectile assembly 20 travels down range. A gas directing tube 44, bored along the centerline of the forward projectile body 42 of the projectile assembly 20, ensures there is sufficient gas flow to the meplat of the projectile assembly. The flow rate through the sintered metal of the projectile assembly will ensure that there will be light gas flowing into the boundary layer for the entire flight of the projectile assembly 20.

The projectile assembly shape, center of gravity, and center of pressure provide for stable flight through all regimes of the projectile assembly 20 flight, from supersonic, through transonic, to subsonic. Using a center of gravity significantly forward of the center of pressure eliminates spin drift. Because the projectile assembly 20 has no striations from lands and grooves, the body of the round remains smooth and is subject to fewer air flow disturbances, which also improves accuracy.

The light gas gun's other mechanisms, the frictionless barrel FIG. 2A, the purge and trigger valves 20/14 all operate identically to those in the first embodiment.

Third Embodiment

In the third embodiment, the necessity to purge the barrel assembly FIG. 2B is eliminated by adding a muzzle valve assembly FIG. 3 on the muzzle end of the barrel assembly FIG. 2B. The muzzle valve assembly FIG. 3 has an opposing multi-leaf valve 28 that allows the projectile 10 to exit the light gas gun while maintaining a positive pressure in the light gas gun after firing. The muzzle valve assembly FIG. 3 also has a plurality of muzzle vent valves 28 that vent excess pressure through a suppression canister 25 to maintain a fixed positive pressure in the frictionless barrel and breech assemblies FIGS. 2B and 4. Venting excess gas through the suppression chamber 25 significantly reduces the acoustic signature of the light gas gun.

Figure 1C:
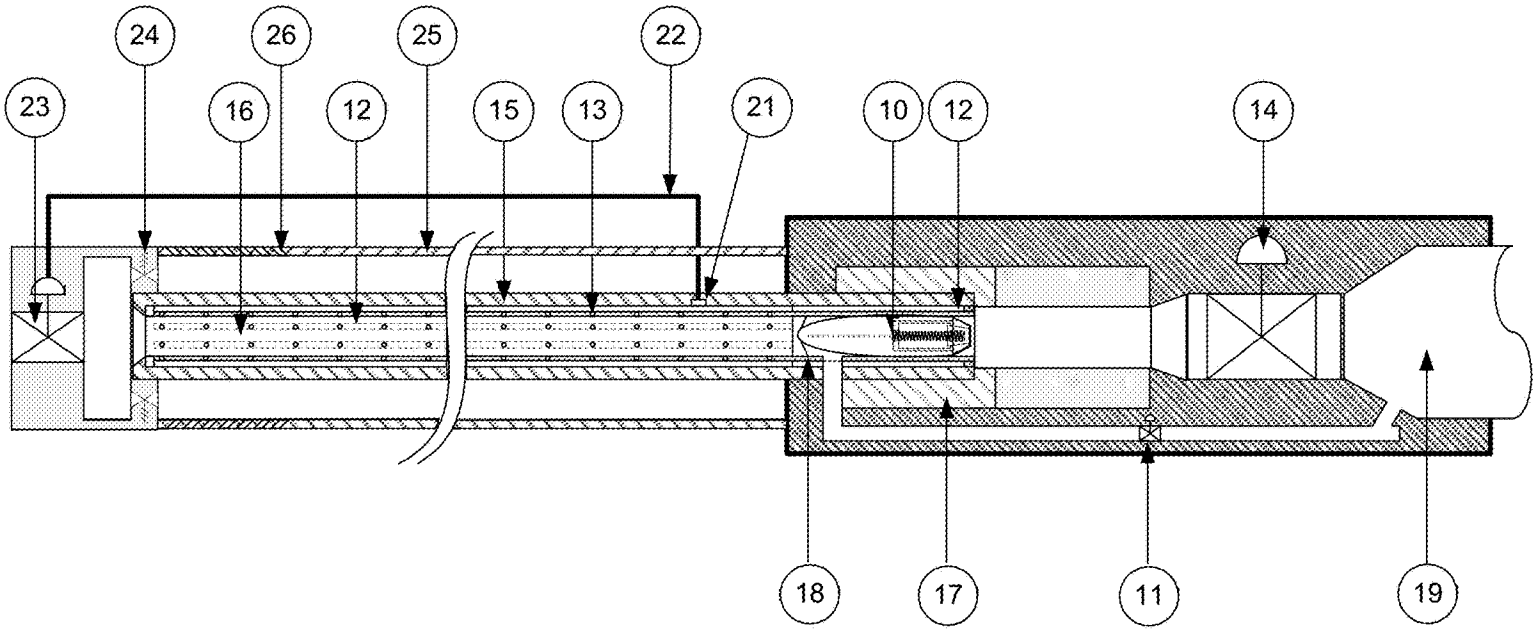
Figure 1D:
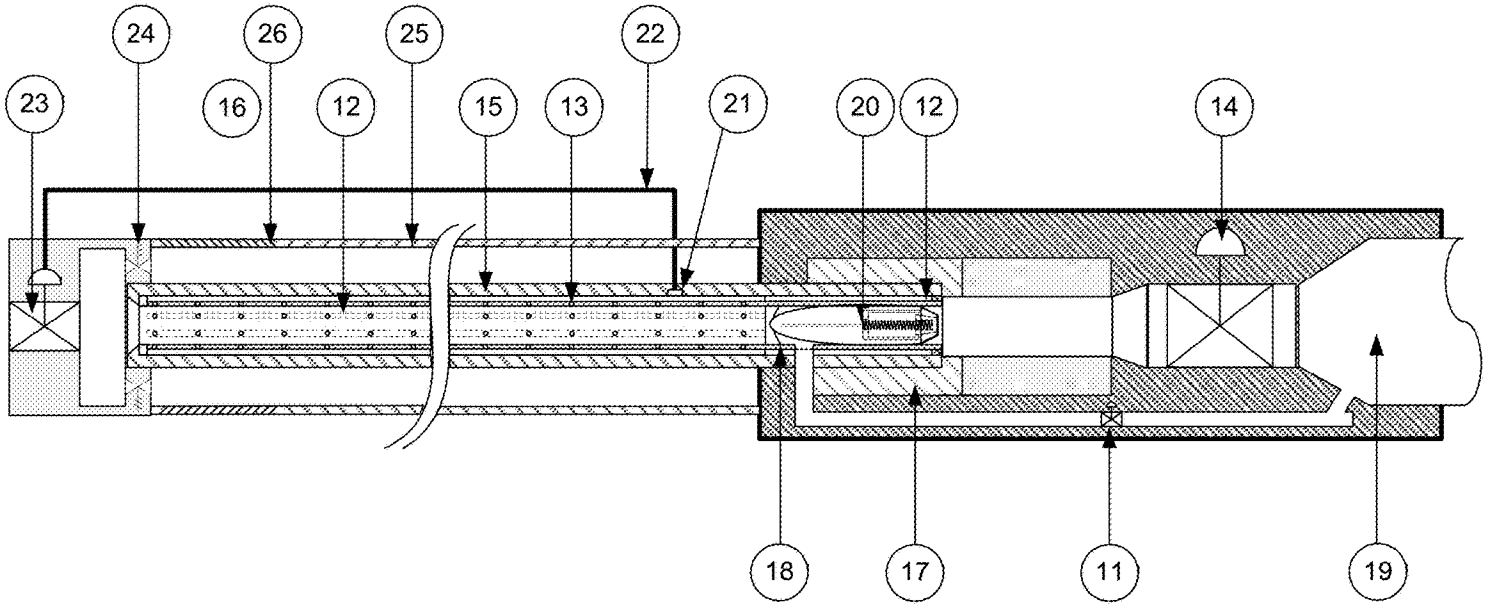

The muzzle valve 23 as shown in FIG. 1C/D is an opposing multi-leaf valve 28, as shown in FIG. 3, where the actuators 32 move the leaves 38 to a position where the leaf bores 36 align with the barrel assembly bore as shown in FIG. 3B. The muzzle valve 27 is opened by a hydraulic actuator 32 that uses the high pressure light gas behind the projectile 10 to open the opposing multi-leaf valve 28. Springs 25 on the leaves 38 close the valve 23 when the barrel assembly FIG. 2B and muzzle valve chamber 37 pressures equalize. The individual leaf bores 36 are larger than the barrel bore 34. Using the opposing multi-leaf valve 28 ensures that no net impulse is imparted to the light gas gun as the valve opens and closes. The muzzle valve 23 is sealed by the muzzle valve O-rings 31.

As the pressure wave in the barrel assembly FIG. 2B reaches the hydraulic piston 21 and presses against the piston, the hydraulic fluid moves the hydraulic actuator 32 in the muzzle valve assembly FIG. 3 that pushes the opposing leaves of the muzzle valve together, aligning the bores in the muzzle valve leaves 38 with the bore of the barrel 34. The opposing muzzle valve leaves 38 are spring loaded, such that when the pressure in the muzzle valve chamber 37 equalizes with the pressure on the hydraulic actuator 32, the springs 35 close the opposing multi-leaf valve 28.

In the third embodiment, the light gas is provided by a piston assembly (not shown) powered by steam, hydraulics, or electrical power. The piston chamber is filled with sufficient light gas that when compressed will produce the desired muzzle velocity. When the trigger signal is received, the motive force moves the piston in the piston chamber, compressing the light gas to the necessary pressure and temperature. When this pressure is reached, the trigger valve 14 opens, providing high pressure light gas to the aft end of the breech 38.

Fourth Embodiment and Best Mode

The fourth embodiment, also offered as the best mode, includes the projectile assembly 20, the frictionless barrel assembly FIG. 2B, and the muzzle valve assembly FIG. 3, as well as the breech assembly FIG. 4.

The projectile assembly 20 is loaded into the breech assembly FIG. 4 by opening the receiver locking bolt 17, inserting the projectile assembly 20, then closing the receiver locking bolt 17. With the projectile assembly 20 loaded, the trigger signal is activated by the operator, opening the trigger valve 14. Light gas entering the breech 38 from the trigger valve 14, propels the projectile assembly 20 down the barrel. A light gas pressure wave also travels the channels 12 on the outside of the inner tube 16 and enters the inner tube 16 through the gas bearing ports 13. The light gas travels the channels 12 faster than the pressure wave behind the projectile assembly 20, allowing the gas bearings to impinge upon the projectile assembly 20 and prevent it from contacting the barrel assembly FIG. 2B walls. Because the greatest diameter of the projectile assembly 20 is smaller than the inside diameter of the inner tube 16 by thousandths of an inch, there is gas flow between the projectile assembly 20 and the inner tube 16 that also helps to keep the projectile assembly 20 centered in the barrel. The trigger valve 14 closes after a specified time, on the order of milliseconds.

When the light gas gun is fired, the pressure behind the projectile assembly 20 increases rapidly. The spring loaded valve 40 in the aft projectile body 41 of the projectile assembly 20, opens as the pressure external to the projectile assembly 20 is greater than the internal pressure plus the compression strength of the projectile spring 43. The valve 40 closes as the internal and external pressures equalize. With high pressure light gas stored in the projectile assembly 20, and because the forward and aft projectile bodies 42/41 and the spring loaded valve 40 are constructed from sintered metal, the light gas starts to flow through the walls of the projectile assembly 20 into the boundary layer as the projectile assembly 20 travels down range. A gas directing tube 44, bored along the centerline of the forward projectile body 42, in the projectile assembly 20 ensures there is sufficient light gas flow to the meplat of the projectile assembly 20. The flow rate through the sintered metal of the projectile assembly 20, will ensure that there will be light gas flowing into the boundary layer for the entire flight of the projectile assembly 20.

The projectile assembly's shape, center of gravity, and center of pressure provide for stable flight through all regimes of the projectile assembly 20 flight, from supersonic, through transonic, to subsonic. Using a center of gravity significantly forward of the center of pressure eliminates spin drift resulting from a spin stabilized round. Because the projectile assembly has no striations from lands and grooves, the body of the projectile assembly 20 remains smooth and is subject to fewer air flow disturbances, which also improves accuracy.

The muzzle valve assembly FIG. 3 has an opposing multi-leaf valve 28, which allows the projectile assembly 20 to exit the light gas gun while maintaining a positive pressure in the light gas gun after firing. The muzzle valve assembly FIG. 3 also has a plurality of muzzle vent valves 27 that vent excess pressure through a suppression canister 29, to maintain a fixed positive pressure in the barrel and breech assemblies FIGS. 2B & 4. Venting excess gas through the suppression canister 29 significantly reduces the acoustic signature of the light gas gun.

The muzzle valve 23 is an opposing multi-leaf valve 28, as shown in FIG. 3, where the hydraulic actuator 32 moves the leaves to a position where the leaf bores align FIG. 3B with the barrel bore 34. The opposing multi-leaf valve 28 is opened by a hydraulic actuator 32 that uses the high pressure light gas behind the projectile assembly 20 to open said valve 28. Springs 35 on the leaves 38, close the opposing multi-leaf valve 28 when the barrel assembly FIG. 2B and muzzle valve chamber 37 pressures equalize. The individual leaf bores 38 are larger than the barrel bore 34. Using the opposing multi-leaf valve 28 ensures that no net impulse is imparted to the light gas gun as the muzzle valve 23 opens and closes.

Figure 6:
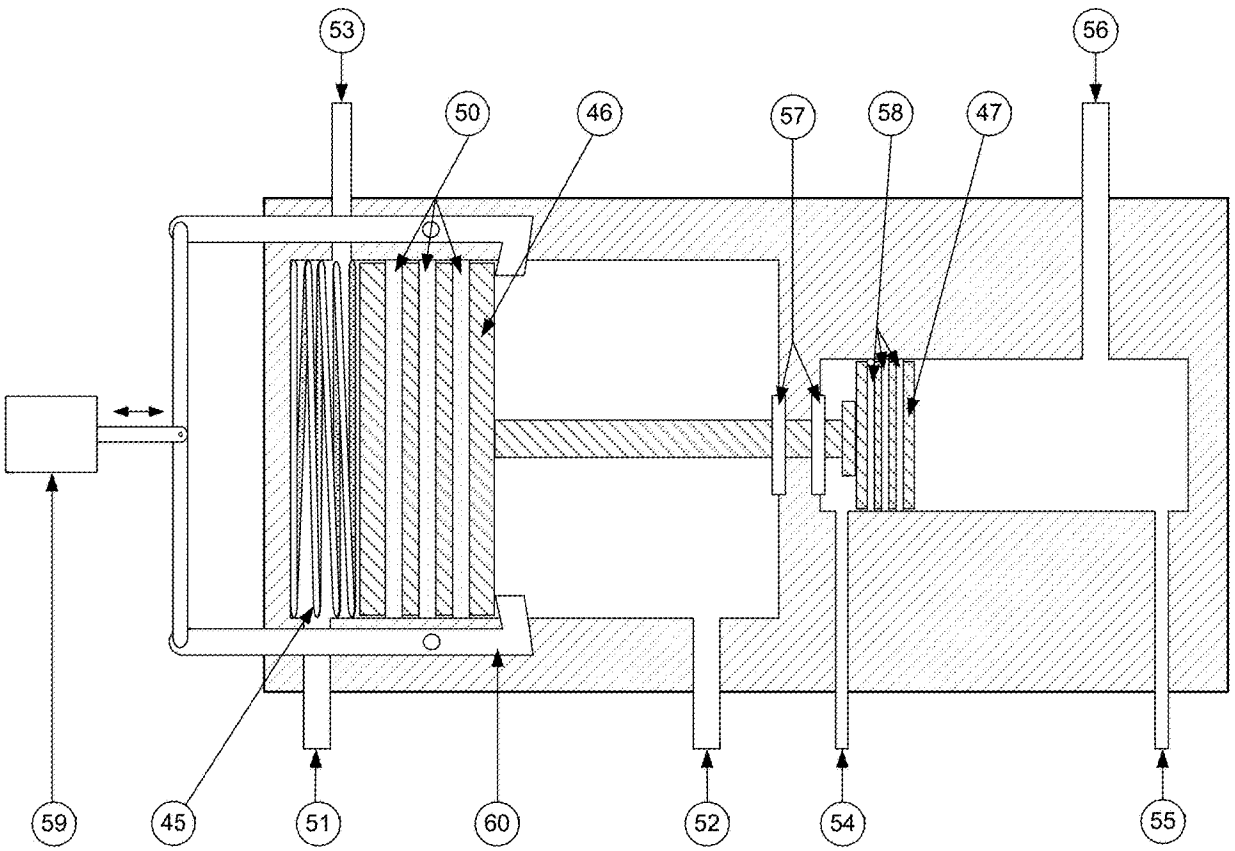
FIG. 6 Dual Piston Assembly Detail

In the fourth embodiment, the light gas is provided by a dual piston assembly FIG. 6 powered by a secondary compressed gas such as carbon dioxide via the $CO_2$ high pressure inlet 51 and the addition of a pressure boosting spring 45. High pressure light gas is compressed to the working pressure by a pressure boosting spring 45 and the $CO_2$-driven piston 46. $CO_2$ is used as the actuating gas because it can be stored compactly at room temperature as a liquid. The $CO_2$-driven piston 46 is significantly larger than the light gas piston 47, multiplying the combined force of the $CO_2$ and spring. When the dual piston assembly FIG. 6 is actuated by the trigger, the $CO_2$ piston lock valve moves the $CO_2$ piston sear, releasing the $CO_2$ driven piston 46 and pressure boosting spring 45, driving the light gas piston 47 to compress the light gas that is then routed from the high pressure light gas outlet 56 to the breech 38, through the trigger valve 14, propelling the projectile assembly 20 down the barrel. The high pressure $CO_2$ in the $CO_2$-driven piston 46 is then vented to the suppression canister 25 via the $CO_2$ high pressure vent 53 and light gas is injected into the high pressure side of the light gas piston 47 through the low pressure light gas inlet 55, driving the dual piston assembly FIG. 6 back to its pre-firing position. $CO_2$ on the front side of the $CO_2$-driven piston 46 is vented to the suppression canister 25 through the $CO_2$ low pressure vent 52. The light gas piston 47 is equipped with an anti-vacuum inlet 54 where low pressure light gas prevents a vacuum being pulled on the aft end of the light gas piston 47 during firing. The pistons are prevented from over-driving by placing the $CO_2$ and light gas outlet vent ports 52/56 short of the end of the piston chambers, thus using gas compression to stop the forward motion of both pistons. Both pistons have piston rings 50/58.

Enablement of the Invention

The barrel assembly FIG. 2A/2B is made up of two concentric tubes, one inside the other. The inner tube 16 bore is five to ten thousandths of an inch greater than the projectile 10 or projectile assembly 20 to allow travel through the inner tube without touching the walls. Inner and outer tubes 16/15 can be made from chrome moly steel or stainless steel. Because the peak operating pressures are substantially less than a standard firearm, the barrel assembly need not be as robust as a standard firearm.

Channels 12 that allow high pressure gas to travel down the barrel are milled on the outside of the inner tube 16. These channels 12 are small compared to the caliber. The interior tube 16 is press fit into the outer tube 15.

There are two different type valves in the muzzle valve assembly FIG. 3. The muzzle valve 23 is an opposing, multiple-leaf valve 28 located at the front of the light gas gun and aligned with the barrel bore 34. The projectile assembly 20 exits the light gas gun through this valve 23. The muzzle valve 23 is a normal fail closed (NFC) valve (i.e., requires hydraulic pressure to open it). A plurality of other muzzle vent valves 24 are located at the rear of the muzzle valve assembly FIG. 3. These dump the bulk of the high pressure light gas into the suppression canister 25. Roughly 80 percent of the light gas exits through the muzzle vent valves 24.

The suppression canister 25 is a cylindrical canister partially filled with porous, non-flammable, acoustic deadening foam. The canister 25 releases the high pressure light gas into the atmosphere through suppression canister vents 26, while minimizing the acoustic signature caused by the escaping gas. The gas must travel through a series of foam baffles to exit the canister 25. The foam also inhibits dust, dirt, and other particulates from entering the rifle barrel and fouling the valves in the muzzle valve assembly FIG. 3.

The muzzle valve assembly FIG. 3 is mechanically attached to the forward end of the barrel assembly FIG. 2B with a gas-tight seal. The breech end of the barrel assembly FIG. 2B slides into the breech body 52 and is mechanically locked onto the breech body 52 with a gas-tight seal.

The breech assembly FIG. 4 controls the actuation gases and trigger valve 14 timing, loads the projectile assembly 20 into the breech 38, and routes the light gas and $CO_2$.

The operator loads the projectile assembly 20 into the breech 38, using compressed $CO_2$ gas to open the receiver locking bolt 17 and push the round into a loading ramp, then closes and locks the receiver locking bolt 17. The round is held in place by the receiver safety 53, which is a mechanical lock in the breech 38, to keep the round in the correct position in the chamber. This is necessary because the round has a non-cylindrical shape and smaller diameter than the barrel bore. It also provides spacing to let gas escape should there be a leak in trigger valve 14.

High pressure light gas is compressed to the working pressure by the pressure boosting spring 45 and $CO_2$-driven piston 46. $CO_2$ is used as the actuating gas because it can be stored at room temperature as a liquid. When the dual piston assembly FIG. 6 is actuated by the trigger, the $CO_2$-driven piston 46 and pressure boosting spring 45 compress the light gas that is then used to propel the projectile down the barrel. This high pressure light gas is routed to the breech 38 through the trigger valve 14.

The breech assembly FIG. 4 has a quick connect/disconnect valve (not shown) on the front end of the breech assembly body 52, under the barrel assembly FIG. 2B, to allow connection to sources of light gas and $CO_2$.

The breech assembly FIG. 4 also has a mechanism to accept a magazine (not shown) containing the projectile rounds. The magazine is sealed in order to maintain a positive pressure on the projectile rounds to ensure they remain filled with light gas until use. The seal is broken when the magazine is inserted into the breech assembly FIG. 4 and locked in place. Locking the magazine breaks the seal, and light gas purges any residual air out of the system through vents routed to the aft end of the suppression canister 25.

The projectile assembly 20 is manufactured using standard machining processes. The forward projectile body 42 and aft projectile body 41 are compression molded using sintered metal. Boring and threading are accomplished by standard CNC lathes, as is lapping of the spring loaded valve 40 and seat in the aft projectile body 41. The forward projectile body is bored to a predetermined depth, and then threaded. A second boring operation drills a gas delivery tube 44 to the front of the forward projectile body, just shy of the meplat. This tube helps to distribute light gas to the forward end of the projectile assembly. Assembly starts by installing the valve spring 43 onto the spring loaded valve seat 40 and inserting the spring loaded valve seat 40 into the aft projectile body 41. This assembly is then screwed into the forward projectile body 42. The milling and boring processes tend to close surface pores, but the small hydrogen molecule and elemental helium will still have acceptable flow. Electric discharge machining can be used if the flow is insufficient, instead of using standard milling operations.

What I claim is:

1. A projectile assembly comprising:

a projectile body generally ogive in shape at the forward end with a rounded nose and a boat tail shape toward the rear of the projectile;

said projectile body is manufactured in two parts, the forward projectile body and the aft projectile body;

said forward projectile body having a bore with a predetermined diameter extending a predetermined depth from a flat aft face, the bore being internally threaded;

said aft projectile body having a through-bore with a second predetermined diameter, the through-bore having a taper at the rear of said aft projectile body and the aft projectile body is threaded externally to allow said forward projectile body and aft projectile body to be screwed together;

said aft projectile body contains a spring loaded valve that seats in the taper at the aft end of said aft projectile body;

said spring loaded valve opens the projectile body to accept and store high pressure light gas internally when light gas pressure externally is greater than the gas pressure internal to said projectile body;

said spring loaded valve closes when external pressure drops below the pressure internal to said projectile assembly;

said projectile body comprised of sintered metal with appropriately coarse grains to allow light gas to flow through the walls of said projectile body, injecting light gas into a boundary layer surrounding said projectile assembly during flight, thereby reducing aerodynamic drag and ballistic disturbances as said projectile assembly travels downrange, which increases range and accuracy while decreasing acoustic signature of said projectile assembly as it travels through the atmosphere;

said projectile body having a forward center of gravity and rearward center of pressure to increase ballistic stability in flight through all flight regimes ranging from supersonic, transonic, to subsonic velocities.

* * * * *